US005625922A

United States Patent [19]

Morad

[11] Patent Number: 5,625,922

[45] Date of Patent: May 6, 1997

[54] ATTACHMENT APPARATUS FOR FORMING A HANDLE

[75] Inventor: Fred I. Morad, Toluca Lake, Calif.

[73] Assignee: Worldwide Integrated Resources, Inc., Glendale, Calif.

[21] Appl. No.: 638,109

[22] Filed: Apr. 26, 1996

[51] Int. Cl.[6] ..... A47B 95/02

[52] U.S. Cl. ..... 16/114 R; 16/DIG. 41; 294/58

[58] Field of Search ..... 16/114 R, 114 A, 16/111 R, DIG. 40, DIG. 41; 403/234–237; 81/177.1; 294/58, 54.5, 59, 30

[56] References Cited

U.S. PATENT DOCUMENTS

| | | | |
|---|---|---|---|
| 1,945,430 | 1/1934 | Garrett | 294/58 |
| 2,410,882 | 11/1946 | Lansden | 294/58 |
| 2,546,387 | 3/1951 | Coffing . | |
| 3,007,595 | 11/1961 | Remley | 16/114 A |
| 3,341,235 | 9/1967 | Mattson et al. | 16/114 R |
| 4,397,489 | 8/1983 | Lind . | |
| 4,881,294 | 11/1989 | Riedl | 16/114 R |
| 5,180,179 | 1/1993 | Salvucci . | |
| 5,343,589 | 9/1994 | Davenport . | |
| 5,352,060 | 10/1994 | Poetker | 403/233 |

FOREIGN PATENT DOCUMENTS

| | | | |
|---|---|---|---|
| 96038 | 5/1963 | Denmark . | |
| 2480241 | 10/1981 | France | 16/114 R |

*Primary Examiner*—Chuck Y. Mah
*Attorney, Agent, or Firm*—Thomas I. Rozsa; Tony D. Chen

[57] ABSTRACT

An attachment apparatus for forming a handle to a broom handle or the like. The attachment apparatus includes a handle member, an intermediate closure member which is installed in the handle member, and a locking member which is installed within the intermediate closure member and the handle member. The locking member has one end with external screw threads and the other end which forms a loop opening. A spring biased pawl is pivotally mounted on the handle member, such that when the tip of the pawl is engaged with the external screw threads of the locking member by the spring, it locks the movement of the handle member. However, by simply pressing the pawl against the spring, an individual can free the movement of the locking member, which in turn frees the movement of the handle member. A broom handle or the like is inserted within the loop opening established by the locking member. Then the spring-biased pawl is pressed while the handle member is pushed towards the locking member until the intermediate closure member abuts against the broom handle while the loop opening on the locking member squeezes the broom handle to secure the attachment apparatus thereon. When the spring-biased pawl is released, the inner screw threads on the engaging tip of the spring biased pawl are engaged to the external screw threads of the locking member, and the handle member can be further threaded on the locking member to precisely adjust the tightness of the attachment apparatus.

20 Claims, 2 Drawing Sheets

ATTACHMENT APPARATUS FOR FORMING A HANDLE

BACKGROUND OF THE INVENTION

1. Field of the Invention

The present invention generally relates to the field of handles. More particularly, the present invention relates to an attachment apparatus for forming a handle.

2. Description of the Prior Art

The following five (5) prior art patents were uncovered in the pertinent field of the present invention:

1. U.S. Pat. No. 2,546,387 issued to Coffing on Mar. 27, 1951 for "Detachable Handle Lock" (hereafter "the Coffing Patent");
2. U.S. Pat. No. 4,397,489 issued to Lind on Aug. 9, 1983 for "Lever Adapter For Door Knob" (hereafter "the Lind Patent");
3. U.S. Pat. No. 5,180,179 issued to Salvucci on Jan. 19, 1993 for "Gas Cylinder Cart Removable Handle" (hereafter "the Salvucci Patent");
4. U.S. Pat. No. 5,343,589 issued to Davenport on Sep. 6, 1994 for "Lobby Dust Pan" (hereafter "the Davenport Patent"); and
5. Danish Patent No. 96,038 (hereafter "the '038 Danish Patent").

The Coffing Patent discloses a detachable handle lock. It comprises two telescopic poles slidable within each other. The larger telescopic pole has a lateral opening thereon. A spring is disposed within the smaller pole therein and has a lateral protruding end. The smaller pole slides within the larger pole such that the lateral protruding end slides therein and registers with the lateral opening on the larger pole whereupon the lateral protruding end springs outwardly, thereby securing the smaller pole with the larger pole.

The Lind Patent discloses a lever adapter for a door knob. It comprises a hollow cylinder which slips over the round knob and is secured to the knob. The cylinder has an end which is closed. The other end is internally threaded to receive an externally threaded annular ring adapted to slip over the supporting shaft of the knob. Threading the ring into the cylinder causes the cylinder to be secured to the knob to provide a handle-type latch mechanism.

The Davenport Patent discloses a lobby dust pan.

The '038 Danish Patent, as disclosed from the figures shows a fastening apparatus.

The Salvucci Patent discloses a detachable handle for a gas cylinder cart. The attachment involves a mechanism which simply involves inserting the bent handle into an opening and then having mating members through which a screw bolt and nut can be inserted.

None of these prior art patents have disclosed an attachment apparatus which can be attached to a broom handle or the like for forming a handle. It is desirable to have an attachment apparatus, where it can be securely fastened onto a broom handle or the like for forming a handle so that an individual can grip the broom handle in the horizontal direction or in the vertical direction, whichever the situation may be. It is also desirable to have a very efficient and also very effective design and construction of an attachment apparatus, where the attachment apparatus can be securely fastened and quickly released.

SUMMARY Of THE INVENTION

The present invention is a novel and unique attachment apparatus for forming a handle to a broom handle or the like.

The present invention attachment apparatus is comprised of three parts which are: a handle member, an intermediate closure member which is installed in the handle member, and a locking member which is installed within the intermediate closure member and the handle member. The locking member has one end with external screw threads and the other end which forms a loop opening. A spring biased pawl is pivotally mounted on the handle member, such that when the tip of the pawl is engaged with the external screw threads of the locking member by the spring, it locks the movement of the handle member. However, by simply pressing the pawl against the spring, an individual can free the movement of the locking member, which in turn frees the movement of the handle member.

A broom handle or the like is inserted within the loop opening established by the locking member. Then the spring-biased pawl is pressed while the handle member is pushed towards the locking member until the intermediate closure member abuts against the broom handle while the loop opening on the locking member squeezes the broom handle to secure the attachment apparatus thereon. When the spring-biased pawl is released, the inner screw threads on the engaging tip of the spring biased pawl are engaged to the external screw threads of the locking member, the handle member can be further threaded on the locking member to precisely adjust the tightness of the attachment apparatus.

The present invention attachment apparatus enables an individual to hold a broom in a horizontal direction or in a vertical direction, whichever the situation may be. While the broom handle is one application, there are numerous other applications where an individual has to hold essentially a vertical type pole in the vertical direction and it is more desirable to have a horizontal handle so that the vertical type pole can be held in a horizontal direction.

It is therefore an object of the present invention to provide an attachment apparatus for attaching to a broom handle or the like, where the attachment apparatus forms a horizontal handle for an individual to grip the broom handle in the horizontal direction.

It is an additional object of the present invention to provide an attachment apparatus having a spring biased pawl pivotally mounted to the handle member, such that when the tip of the pawl is engaged with the locking member by the spring, it locks the movement of the handle member. However, by simply pressing the pawl against the spring, an individual can free the movement of the locking member, which in turn frees the movement of the handle member.

It is a further object of the present invention to provide an attachment apparatus, where external screw threads are provided on the locking member, and inner screw threads are provided on the engaging tip of the spring biased pawl on the handle member, so that as the spring biased pawl is engaged to the external screw threads of the locking member, the handle member can be further threaded on the locking member to precisely adjust the tightness of the attachment apparatus.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
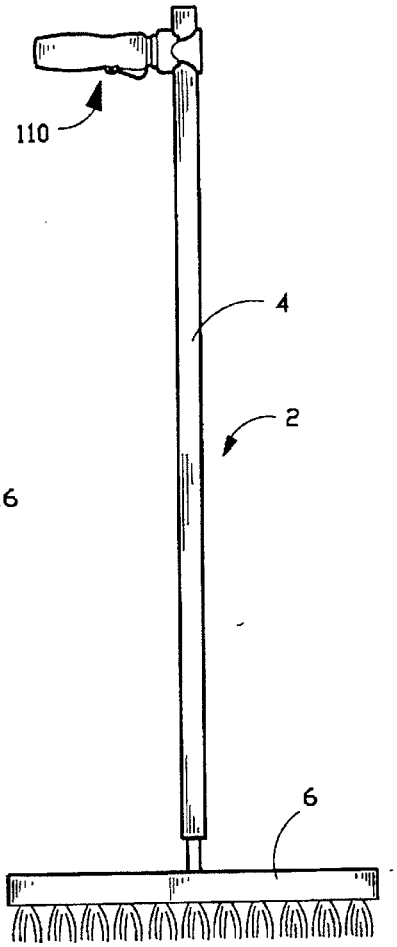
FIG. 1 is an illustration of the present invention attachment apparatus attached to a broom handle for forming a handle perpendicular to the broom handle.

Referring to FIG. 1, there is shown at 110 an illustration of the present invention attachment apparatus for attaching to and forming a horizontal handle on a broom 2 which has a handle 4 and a head 6. The attachment apparatus 110 is generally perpendicular to the broom handle 4 which makes it easier to hold the broom 2. It will be appreciated that the broom 2 shown above is merely one illustrative embodiment and the present invention attachment apparatus 110 may be attached to any suitable means. By way of example, the attachment apparatus 110 may be attached to any handle for forming a horizontal handle, for example, an elongated pole, shaft or any other suitable means. The illustration of the broom 2 shown in FIG. 1 can be rotated 90° such that the broom handle 4 is parallel to the ground, where the present invention attachment apparatus 110 now forms a vertical handle. In addition, while the depiction in FIG. 1 shows the present invention attachment apparatus 10 located adjacent the end of the broom handle 4, another advantage of the present invention is that the attachment apparatus can be located anywhere along the length of the broom handle 4 so that it can be adjusted to the height of the specific person. Therefore, a very short person can have the attachment apparatus 10 located at a much lower position on the broom handle 4 so that it will be easier for the person to handle the broom.

Figure 2:
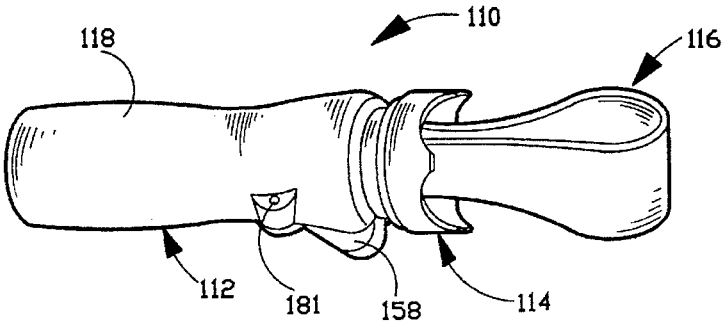
FIG. 2 is a perspective view of the present invention attachment apparatus.

Referring to FIG. 2, there is shown perspective view of the present invention attachment apparatus 110. The attachment apparatus 110 is comprised of three components: a handle member 112, an intermediate closure member 114 and a locking member 116.

Figure 5:
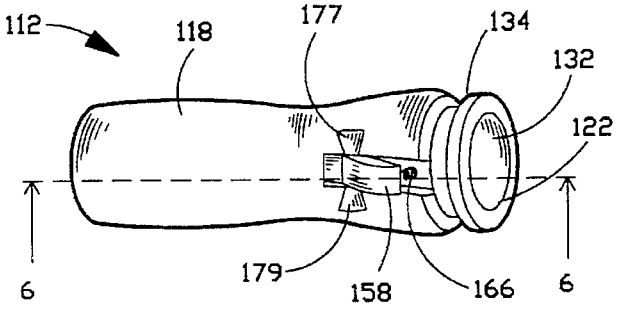
FIG. 5 is a perspective view of the handle member of the present invention attachment apparatus.
Figure 6:
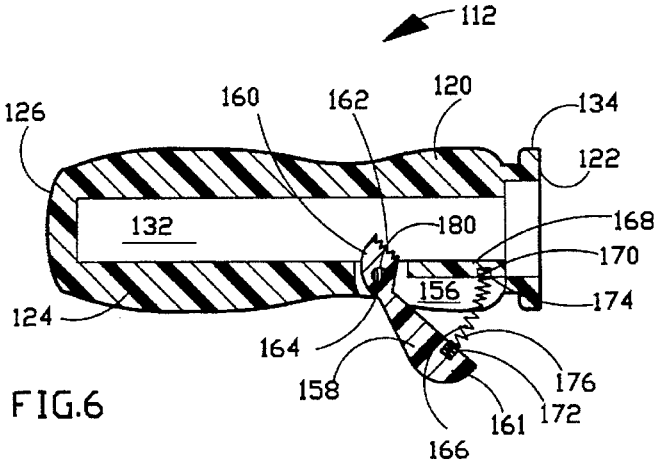
FIG. 6 is a cross-sectional view taken along line 6—6 of FIG. 5.

Referring to FIGS. 5 and 6, there are shown respective perspective and cross-sectional views of the handle member 112 of the present invention. The handle member 112 is generally a cylindrical shaped body 118. The cylindrical shaped body 118 has a proximal portion 120 with a proximal open end 122 and a distal portion 124 with a distal closed end 126. A circular flange 134 is provided and formed at the proximal open end 122 of the proximal portion 120 of the handle member 112 for supporting the intermediate closure member 114.

The handle member 112 further has a central slot 132 for accommodating the proximal portion 147 of the locking member 116, and a side slot 156 for accommodating a pawl 158. The central slot 132 extends from the proximal open end 122 through the distal portion 124. The side slot 156 is located at the proximal portion 120. A thin wall 168 is disposed between the central slot 132 and the side slot 156 to partially divide them, so the side slot 156 is partially connected with the central slot 132.

The pawl 158 has an inwardly protruded tip 160 and an outwardly extended tail 161. The tip 160 is provided with inner screw threads 162 for engaging with the external screw threads 148 of the locking member 116. The pawl 158 is pivotally mounted in the side slot 156 by a roll pin 164 and biased by a coil spring 166. There are two protruding bosses 177 and 179 located and attached on the exterior surface of the cylindrical shaped body 118. Each protruding boss has an aligned hole 181 therein, wherein the tip 160 is positioned therebetween, and a hole 180 on the pawl 158, all for receiving the roll pin 164. In addition, there is an outward facing recess 170 provided on the thin wall 168, and an inward facing recess 172 provided on the pawl 158, for adapting ends 174 and 176 of the coil spring 166 respectively. As the pawl 158 is pivoted by the roll pin 164, it is biased by the coil spring 166, where its tip 160 is extending into the central slot 132 of the handle member 112 and its tail 161 is extending out of the side slot 156 (see FIG. 6). The pawl 158 and the spring 166 are securely attached to the handle member 112. The width of the pawl 158 is approximately the same as the width of the side slot 156, so that when the spring 166 is installed in the side slot 156, it is not exposed to outside of the handle member 112.

Figure 4:
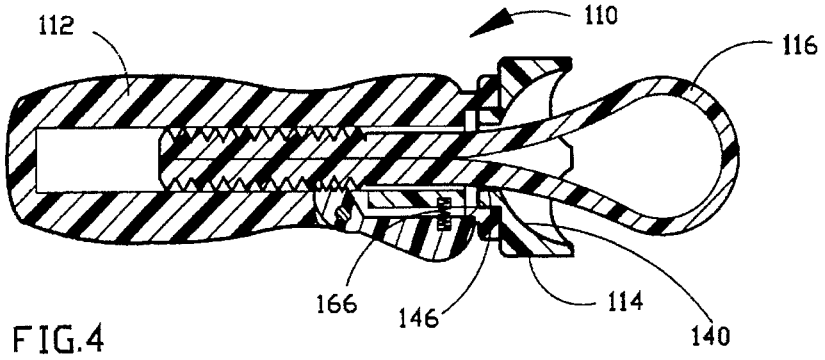
FIG. 4 is a longitudinal cross-sectional of the present invention attachment apparatus shown in FIG. 2.
Figure 7:
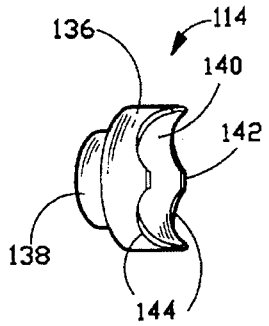
FIG. 7 is a perspective view of the intermediate closure member of the present invention attachment apparatus.

Referring to FIGS. 2, 4 and 7, where FIG. 4 is a longitudinal cross-sectional view of the entire attachment apparatus 110, and FIG. 7 is a perspective view of the intermediate closure member 114 of the present invention. The intermediate closure member 114 has a wide engagement portion 136 and a short narrow shaft portion 138. The wide engagement portion 136 has an interior concave cavity 140 and a periphery rim 142 with a multiplicity of spaced apart concave surfaces 144. The shaft portion 138 has a central slot opening 146 therethrough, where the central slot opening 146 communicates with the concave cavity 140 of the wide engagement portion 136. The shaft portion 138 is installed at the proximal open end 122 of the handle member 112 and located within the proximal portion 120 (see FIG. 4). The bottom of the wide engagement portion 136 is supported by the circular flange 134 on the handle member 112.

Figure 3:
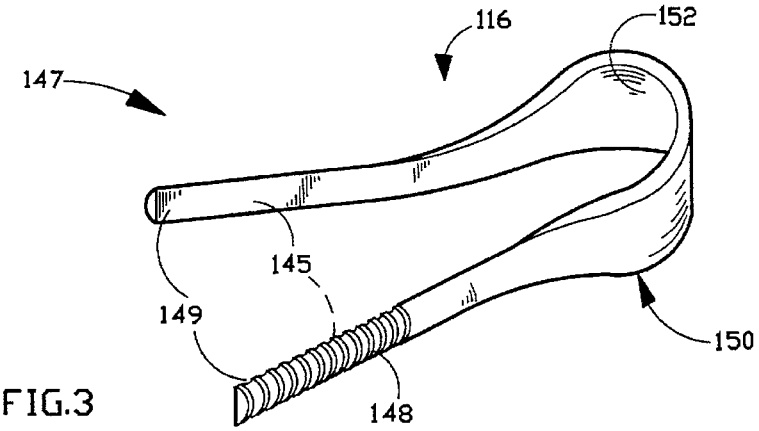
FIG. 3 is a perspective view of the locking member of the present invention attachment apparatus.

Referring to FIG. 3, there is shown a perspective view of the locking member 116 of the present invention. The locking member 116 has a proximal portion 147 which has two elongated legs 149 at opposite sides and a distal portion 150 which forms a loop opening 152 for looping around the broom handle 4 (see FIG. 1). Each leg 149 has a flat internal surface 145 and external screw threads 148. The proximal portion 147 of the locking member 116 is inserted through the concave cavity 140 and the central slot opening 146 of the intermediate closure member 114 and the central slot 132 of the handle member 112, such that the proximal portion 147 is seated within the handle member 112. Once the locking member 116 is installed within the handle member 112, the flat internal surfaces 145 on the two legs 149 of the proximal portion 147 abut against each other as shown in FIG. 4, and the external screw threads 148 are engaged with the spring-biased pawl of the handle member 112.

Referring again to FIGS. 1 through 7, the intermediate closure member 114 is installed within the handle member 112 such that the bottom of the closure member 114 is supported by the circular flange 134 of the handle member 112. The locking member 116 is then installed by inserting the proximal portion 147 through the concave cavity 140 and the central slot opening 146 of the intermediate closure member 114 and the central slot 132 of the handle member 112, where the tail 161 of the pawl 158 is not pressed or released. As the tail 161 of the pawl 158 is not pressed, the pawl 158 will be biased by the coil spring 166. Once the locking member 116 is installed within the handle member 112, the internal flat surfaces 145 on the proximal portion 147 abut against each other as shown in FIG. 4. The broom handle is inserted within the loop opening 152 established by the locking member 116, where a respective two of the multiplicity of concave surfaces 144 of the intermediate closure member 114 abut against the broom handle while the loop opening 152 of the locking member 116 squeezes the broom handle to tighten the attachment apparatus 110 thereon. The pawl 158 is biased by the coil spring 166 such that its tip 160 is engaged with the proximal portion 147 of the locking member 116. The handle member 112 is locked on the locking member 116 for preventing the locking member 116 from sliding out from the handle member 112. The handle member 112 can be further threaded on the locking member 116 to precisely adjust the tightness of the attachment apparatus 110 by further pushing the handle member 112 towards the locking member 116 and rotating the handle member 112 in the clockwise direction, such that the inner screw threads 162 on the tip 160 of the pawl 158 engage with the external screw threads 148 on the proximal portion 147 of the locking member 116. It will be appreciated that the handle member 112 may be rotated in the counter-clockwise direction to tighten the attachment apparatus 110 or vice versa.

When the tail 161 of the pawl 158 is pressed against the coil spring 166, the handle member 112 is released from the locking member 116, and the tip 160 of the pawl 158 is disengaged from the proximal portion 147 of the locking member 116, which allows the locking member 116 to slide freely out from the handle member 112. The handle member 112 is slidable on the locking member 116 as the pawl 158 is pressed, thereby releasing the handle member 112 from the locking member 116, which thereby becomes a very quick operation.

The present invention conforms to conventional forms of manufacture or any other conventional way known to one skilled in the art. The attachment apparatus of can be made from several materials. By way of example, the attachment apparatus can be made of molded plastic or other suitable material. The manufacturing process which could accommodate the construction of the attachment apparatus may be injection, thermoform, etc. or other molding process.

The present invention may be used in one application, for example, in a movie theater where a person has a vertical dustpan with a handle on it. It would be easier to utilize the vertical arm by having the present invention attachment apparatus tightened onto the vertical dustpan handle, thereby making it easier to hold the dustpan handle.

In another application the present invention attachment apparatus may be attached to a vertical hiking pole. It might be easier to hold it in a horizontal manner and therefore the present invention attachment apparatus may be tightened onto the top end of the vertical hiking pole so that an individual could hold it in the horizontal direction.

In another application of the present invention attachment apparatus, it may be attached to ski poles where it might be easier for someone to have a horizontal grip on the vertical ski pole.

Defined in detail, the present invention is an attachment apparatus for attaching to a handle of a broom or the like, the apparatus comprising: (a) a handle member having a generally cylindrical shaped body, the cylindrical shaped body having a proximal portion with a proximal open end, a distal portion with a distal closed end, a central slot extending from the proximal open end through the distal portion, and a side slot interconnecting the central slot and located on the proximal portion; (b) an intermediate closure member having a wide engagement portion, a short narrow shaft portion, and a central opening extending therethrough, the wide engagement portion having a periphery rim with a multiplicity of spaced apart concave surfaces, the shaft portion being installed at the proximal open end of the handle member and located within the proximal portion; (c) a locking member having a proximal portion with external screw threads and a distal portion forming a loop opening for looping around the broom handle, the proximal portion being inserted through the central opening of the intermediate closure member and the central slot of the handle member such that the proximal portion is located within the central slot of the handle member; (d) a pawl pivotally mounted in the side slot of the handle member and having a tip with inner screw threads; (e) a coil spring being installed in the side slot of the handle member and biasing the tip of the pawl to engage it to the external screw threads on the proximal portion of the locking member; (f) a thin wall disposed between the central slot and the side slot to partially divide them, so that the side slot is partially connected with the central slot; (g) the thin wall having an outward facing recess for adapting to one end of the coil spring; (h) the pawl having an inward facing recess located remote from the tip for adapting the other end of the coil spring; and (i) the handle member rotatable on the locking member such that the inner screw threads on the pawl threadedly engage with the external screw threads on the locking member until a respective two of the multiplicity of concave surfaces on the wide engagement portion of the intermediate closure member abut against the broom handle while the loop opening of the locking member squeezes the broom handle to tighten the attachment apparatus thereon; (j) whereby the pawl biased by the coil spring and its tip is engaged to the proximal portion of the locking member, the handle member is locked on the locking member for preventing the locking member from sliding out from the handle member so that the handle member can be fastened thereto, and the handle member can be further threaded on the locking member to precisely adjust the tightness of the attachment apparatus, and when the pawl is pressed against the coil spring and its tip is disengaged from the proximal portion of the locking member, the handle member is unlocked and can be slid on the locking member for allowing the handle member to be released.

Defined broadly, the present invention is an attachment apparatus for attaching to a pole or the like, the apparatus comprising: (a) a handle member having a proximal open end, a distal closed end, a central slot, and a side slot interconnecting the central slot and located adjacent to the proximal open end; (b) a closure member having an engagement portion, a shaft portion, and an opening extending therethrough, the shaft portion being installed at the proximal open end of the handle member; (c) a locking member having a proximal portion with external screw threads and a distal portion forming a loop opening for looping around the pole, the proximal portion being inserted through the opening of the closure member and the central slot of the handle member such that the proximal portion is located within the central slot of the handle member; (d) a pawl pivotally mounted in the side slot of the handle member and having a tip with inner screw threads; (e) a spring being installed in the side slot of the handle member and biasing the tip of the pawl to engage it onto the external screw threads on the proximal portion of the locking member; and (f) the handle member rotatable on the locking member such that the inner screw threads on the pawl threadedly engage with the external screw threads on the locking member until the engagement portion of the closure member abuts against the pole while the loop opening of the locking member squeezes the pole to tighten the attachment apparatus thereon; (g) whereby the pawl biased by the spring and its tip is engaged to the proximal portion of the locking member, the handle member is locked on the locking member for preventing the locking member from sliding out from the locking member so that the handle member can be fastened, and the handle member can be further threaded on the locking member to precisely adjust the tightness of the attachment apparatus, and when the pawl is pressed against the spring and its tip is disengaged from the proximal portion of the locking member, the handle member is unlocked and can be slid on the locking member for allowing the handle member to be released.

Defined more broadly, the present invention is an attachment apparatus for attaching to a pole or the like, the apparatus comprising: (a) a handle member having a central slot and a side slot; (b) a locking member having one end with external screw threads and the other end with a loop opening for looping around the pole, where the locking member is slidably installed within the central slot of the handle member; (c) a pawl pivotally mounted to the handle member and biased by a spring such that its tip is engaged onto the one end of the locking member, the spring being installed in the side slot; and (d) the tip of the spring biased pawl further having inner threads threadedly engaging the external screw threads of the locking member for locking the locking member within the handle member; (e) whereby the pawl biased by the spring and its tip is engaged to the locking member, the handle member is locked on the locking member for preventing the locking member from sliding out from the locking member so that the handle member can be fastened, and the handle member can be further threaded on the locking member to precisely adjust the tightness of the attachment apparatus, and when the spring biased pawl is pressed against the spring and its tip is disengaged from the from the locking member, and the handle member is unlocked and can be slid on the locking member for allowing the handle member to be released, thereby releasing the pole.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An attachment apparatus for attaching to a handle of a broom or the like, the apparatus comprising:

a. a handle member having a generally cylindrical shaped body, the cylindrical shaped body having a proximal portion with a proximal open end, a distal portion with a distal closed end, a central slot extending from the proximal open end through the distal portion, and a side slot interconnecting the central slot and located on the proximal portion;

b. an intermediate closure member having a wide engagement portion, a short narrow shaft portion, and a central opening extending therethrough, the wide engagement portion having a periphery rim with a multiplicity of spaced apart concave surfaces, the shaft portion being installed at said proximal open end of said handle member and located within said proximal portion;

c. a locking member having a proximal portion with external screw threads and a distal portion forming a loop opening for looping around said broom handle, the proximal portion being inserted through said central opening of said intermediate closure member and said central slot of said handle member such that the proximal portion is located within said central slot of said handle member;

d. a pawl pivotally mounted in said side slot of said handle member and having a tip with inner screw threads;

e. a coil spring being installed in said side slot of said handle member and biasing said tip of said pawl to engage it to said external screw threads on said proximal portion of said locking member;

f. a thin wall disposed between said central slot and said side slot to partially divide them, so that said side slot is partially connected with said central slot;

g. said thin wall having an outward facing recess for adapting to one end of said coil spring;

h. said pawl having an inward facing recess located remote from said tip for adapting the other end of said coil spring; and i. said handle member rotatable on said locking member such that said inner screw threads on said pawl threadedly engage with said external screw threads on said locking member until a respective two of said multiplicity of concave surfaces on said wide engagement portion of said intermediate closure member abut against said broom handle while said loop opening of said locking member squeezes said broom handle to tighten said attachment apparatus thereon;

j. whereby said pawl biased by said coil spring and its tip is engaged to said proximal portion of said locking member, said handle member is locked on said locking member for preventing said locking member from sliding out from said handle member so that said handle member can be fastened thereto, and said handle member can be further threaded on said locking member to precisely adjust the tightness of said attachment apparatus, and when said pawl is pressed against said coil spring and its tip is disengaged from said proximal portion of said locking member, said handle member is unlocked and can be slid on said locking member for allowing said handle member to be released.

2. The attachment apparatus in accordance with claim 1 wherein said handle member, said intermediate closure member and said locking member are made of plastic material.

3. The attachment apparatus in accordance with claim 1 wherein said pawl is pivotally mounted to said handle member by a roll pin.

4. The attachment apparatus in accordance with claim 1 wherein the width of said pawl is approximately the same as the width of said side slot.

5. An attachment apparatus for attaching to a pole or the like, the apparatus comprising:

a. a handle member having a proximal open end, a distal closed end, a central slot, and a side slot interconnecting the central slot and located adjacent to the proximal open end;

b. a closure member having an engagement portion, a shaft portion, and an opening extending therethrough, the shaft portion being installed at said proximal open end of said handle member;

c. a locking member having a proximal portion with external screw threads and a distal portion forming a loop opening for looping around said pole, the proximal portion being inserted through said opening of said closure member and said central slot of said handle member such that the proximal portion is located within said central slot of said handle member;

d. a pawl pivotally mounted in said side slot of said handle member and having a tip with inner screw threads;

e. a spring being installed in said side slot of said handle member and biasing said tip of said pawl to engage it onto said external screw threads on said proximal portion of said locking member; and f. said handle member rotatable on said locking member such that said inner screw threads on said pawl threadedly engage with said external screw threads on said locking member until said engagement portion of said closure member abuts against said pole while said loop opening of said locking member squeezes said pole to tighten said attachment apparatus thereon;

g. whereby said pawl biased by said spring and its tip is engaged to said proximal portion of said locking member, said handle member is locked on said locking member for preventing said locking member from sliding out from said locking member so that said handle member can be fastened, and said handle member can be further threaded on said locking member to precisely adjust the tightness of said attachment apparatus, and when said pawl is pressed against said spring and its tip is disengaged from said proximal portion of said locking member, said handle member is unlocked and can be slid on said locking member for allowing said handle member to be released.

6. The attachment apparatus in accordance with claim 5 wherein said handle member, said closure member and said locking member are made of plastic material.

7. The attachment apparatus in accordance with claim 5 wherein said engagement portion of said closure member further has a periphery rim with a multiplicity of spaced apart concave surfaces, where a respective two of the multiplicity of spaced apart concave surfaces are adapted to abut against said pole.

8. The attachment apparatus in accordance with claim 5 further comprising a thin wall disposed between said central slot and said side slot to partially divide them, so that said side slot is partially connected with said central slot.

9. The attachment apparatus in accordance with claim 8 wherein said thin wall has an outward facing recess for adapting to one end of said spring.

10. The attachment apparatus in accordance with claim 5 wherein said pawl has an inward facing recess located remote from said tip for adapting the other end of said spring.

11. The attachment apparatus in accordance with claim 5 wherein said pawl is pivotally mounted to said handle member by a roll pin.

12. The attachment apparatus in accordance with claim 5 wherein the width of said pawl is approximately the same as the width of said side slot.

13. An attachment apparatus for attaching to a pole or the like, the apparatus comprising:

a. a handle member having a central slot and a side slot;

b. a locking member having one end with external screw threads and the other end with a loop opening for looping around said pole, where the locking member is slidably installed within said central slot of said handle member;

c. a pawl pivotally mounted to said handle member and biased by a spring such that its tip is engaged onto the one end of said locking member, the spring being installed in said side slot; and d. said tip of said spring biased pawl further having inner threads threadedly engaging said external screw threads of said locking member for locking said locking member within said handle member;

e. whereby said pawl biased by said spring and its tip is engaged to said locking member, said handle member is locked on said locking member for preventing said locking member from sliding out from said locking member so that said handle member can be fastened, and said handle member can be further threaded on said locking member to precisely adjust the tightness of said attachment apparatus, and when said spring biased pawl is pressed against said spring and its tip is disengaged from said from said locking member, said handle member is unlocked and can be slid on said locking member for allowing said handle member to be released, thereby releasing said pole.

14. The attachment apparatus in accordance with claim 13 further comprising a thin wall disposed between said central slot and said side slot to partially divide them, so that said side slot is partially connected with said central slot.

15. The attachment apparatus in accordance with claim 14 wherein said thin wall has an outward facing recess for adapting to one end of said spring.

16. The attachment apparatus in accordance with claim 13 further comprising an intermediate closure member installed between said locking member and said handle member for abutting against said pole.

17. The attachment apparatus in accordance with claim 16 wherein said intermediate closure member has a wide engagement portion with a multiplicity of spaced apart concave surfaces, where a respective two of the multiplicity of spaced apart concave surfaces are adapted to abut against said pole.

18. The attachment apparatus in accordance with claim 13 wherein said pawl has an inward facing recess located remote from said tip for adapting the other end of said spring.

19. The attachment apparatus in accordance with claim 13 wherein said pawl is pivotally mounted to said handle member by a roll pin.

20. The attachment apparatus in accordance with claim 13 wherein the width of said pawl is approximately the same as the width of said side slot.

* * * * *